US010075784B2

(12) United States Patent
Fu et al.

(10) Patent No.: US 10,075,784 B2
(45) Date of Patent: Sep. 11, 2018

(54) METHOD OF MANUFACTURING ELASTIC HEADPHONE WIRE AND PRODUCT THEREOF

(71) Applicants: DONGGUAN YINGTONG WIRE LTD, Guangdong (CN); HUBEI YINGTONG ELECTRONICS CO., LTD, Hubei (CN)

(72) Inventors: Hualiang Fu, Dongguan (CN); Wei Xiang, Guandong (CN)

(73) Assignee: DONGGUAN YINGTONG WIRE LTD, Dongguan (CN)

( * ) Notice: Subject to any disclaimer, the term of this patent is extended or adjusted under 35 U.S.C. 154(b) by 0 days.

(21) Appl. No.: 14/917,277

(22) PCT Filed: Nov. 20, 2014

(86) PCT No.: PCT/CN2014/091767
§ 371 (c)(1),
(2) Date: Mar. 8, 2016

(87) PCT Pub. No.: WO2015/074583
PCT Pub. Date: May 28, 2015

(65) Prior Publication Data

US 2016/0219357 A1 Jul. 28, 2016

(30) Foreign Application Priority Data

Nov. 22, 2013 (CN) ..... 2013 1 0594475

(51) Int. Cl.
*H01B 7/00* (2006.01)
*H04R 1/10* (2006.01)
*H01B 13/008* (2006.01)
*H01B 7/06* (2006.01)

(52) U.S. Cl.
CPC ..... *H04R 1/1033* (2013.01); *H01B 13/008* (2013.01); *H01B 7/06* (2013.01)

(58) Field of Classification Search
CPC ..... H01B 7/02; H01B 7/06; H01B 11/02
USPC ..... 174/69, 102 R, 106 R
See application file for complete search history.

(56) References Cited

U.S. PATENT DOCUMENTS 1,989,066 A * 1/1935 Shaw ..... H01B 7/06 156/47
3,048,078 A * 8/1962 Kaplan ..... H01B 7/06 174/69
3,126,442 A * 3/1964 Roberts ..... H01B 7/06 174/113 C
3,823,253 A * 7/1974 Walters ..... H01B 7/06 174/113 C
4,683,349 A * 7/1987 Takebe ..... H01B 7/06 174/113 C
4,861,945 A * 8/1989 Buck ..... H01B 7/065 174/106 R (Continued)

*Primary Examiner* — William H Mayo, III

(57) ABSTRACT

A method of manufacturing elastic headphone wire, having steps of: manufacturing an elastic core wire, weaving the conductive layer around an outer surface of the elastic core wire, and manufacturing an elastic insulating protective layer which sleeves on a periphery of the conductive layer to form the elastic headphone wire. The elastic headphone wire has excellent flexibility and longer extension length, extending the service life, and broadening the use way of the headphone wire.

5 Claims, 1 Drawing Sheet

(56) References Cited

U.S. PATENT DOCUMENTS

| | | | | |
|---|---|---|---|---|
| 5,374,782 | A * | 12/1994 | Taylor | H01B 11/1813 174/102 R |
| 6,727,433 | B2 * | 4/2004 | Tsai | H01B 7/361 174/110 R |
| 8,294,029 | B2 * | 10/2012 | Tatsumi | H01B 7/06 174/110 R |
| 2003/0121694 | A1 * | 7/2003 | Grogl | H01B 3/441 174/113 R |
| 2009/0314510 | A1 * | 12/2009 | Kukowski | G01R 31/021 174/69 |
| 2011/0088925 | A1 * | 4/2011 | Tatsumi | H01B 7/06 174/69 |
| 2014/0131096 | A1 * | 5/2014 | Silverman | H01B 11/1008 174/74 R |

* cited by examiner

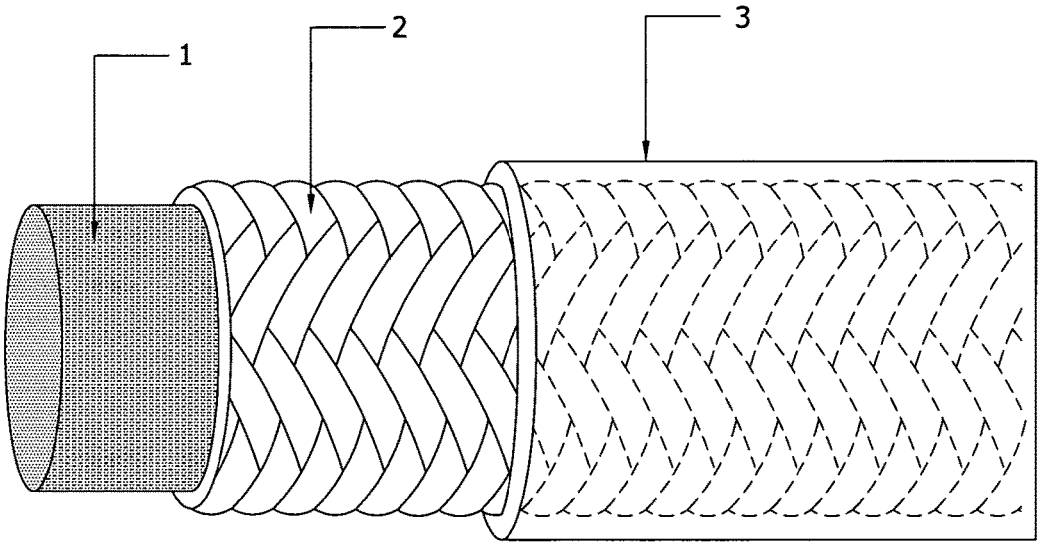
1
2
3

METHOD OF MANUFACTURING ELASTIC HEADPHONE WIRE AND PRODUCT THEREOF

FIELD OF THE INVENTION

The present invention relates to a technical field of a wire, particularly to a method of manufacturing elastic headphone wire and product thereof.

BACKGROUND OF THE INVENTION

The common wire is typically made of metal wire, but its bending performance is not strong enough to satisfy the use of some activities. For example Chinese patent application No. 2006200904473, titled "extendable wire" and Chinese patent application No. 86203746, titled "flexible conducting wire and cable" reveal two stretchable conductors, the common features of which are the center of the conductor that are made of a rubber strip and a conducting structure wrapped around the rubber strip. The two inventions have the advantage of a certain flexibility, However, the problem of metal fatigue is inevitable, the repeated bending to the conductor will cause breakage of the metal conductor, so the two products in actual use will still exist the more serious problem of short life.

SUMMARY OF INVENTION

The objective of the present invention is directed to the above problems and is provided for a method of manufacturing elastic headphone wire and product thereof, whereby the headphone wires have excellent extension and longer extending length, and improve the service life and the use effect.

The technical solution being adopted to achieve the above objective is:

a method of manufacturing elastic headphone wire, comprising steps of:

I. manufacturing an elastic core wire; using an injection molding machine to produce an elastic yarn as the elastic core wire of the elastic headphone;

II. weaving a conductive layer: weaving the conductive layer around an outer surface of the elastic core wire, wherein the conductive layer is an elastic stretchable mesh tube woven by enameled wires with the elastic core wire at the center, and the elastic stretchable mesh tube is coupled with the elastic core wire;

III. manufacturing an elastic insulating protective layer: using the injection molding machine to produce the cylindrical insulating protective layer by injection moulding;

wherein the elastic insulating protective layer is transparent or translucent, and an inner diameter of the elastic insulating protective layer is slightly larger than an outer diameter of the conductive layer; the elastic insulating protective layer is sleeved on a periphery of the conductive layer to form the elastic headphone wire, Wherein the enameled wires comprises the same or a different color of paint disposed on surfaces thereof, so that the conductive layer is woven into plane patterns.

Wherein the elastic insulating protective layer is coated with a lubricant disposed on an inner surface thereof.

An elastic headphone wire comprise an elastic core wire, a conductive layer woven on an outer surface of the elastic core wire, and an elastic insulting protective layer sleeved on a periphery of the conductive layer.

Wherein the conductive layer is woven into an elastic stretchable mesh tube by enameled wires with the elastic core wire at the center.

Wherein the elastic insulating protective layer is coated with a lubricant disposed on an inner surface thereof.

Wherein the enameled wires comprises the same or a different color of paint disposed on surfaces thereof, so that the conductive layer is woven into plane patterns.

The advantages of the present invention are that:

the elastic headphone wire is composed of the elastic core wire, the conductive layer, and the elastic insulating protective layer, so the elastic headphone wire has excellent flexibility and longer extension length, extends the service life, and broaden the use way of the headphone wire;

the lubricant coated on the inner surface of the elastic insulating protective layer can avoid wear and tear between the elastic insulating protective layer and the conductive layer when the elastic headphone wire is being bent or extended; and the enameled wires painted with different colors on the surface can he woven in colorful pattern.

BRIEF DESCRIPTION OF THE DRAWINGS

FIG. 1 is a schematic view of the overall structure of the present invention; and

DETAILED DESCRIPTION OF THE PREFERRED EMBODIMENTS

Referring to FIG. 1, the preferred embodiment provides a method of manufacturing elastic headphone wire, comprising steps of:

I. manufacturing an elastic core wire (1); using an injection molding machine to produce an elastic yarn as the elastic core wire of the elastic headphone;

II. weaving a conductive layer (2): weaving the conductive layer around an outer surface of the elastic core wire (1), wherein the conductive layer is an elastic stretchable mesh tube woven by enameled wires with the elastic core wire at the center, and the elastic stretchable mesh tube is coupled with the elastic core wire;

III. manufacturing an elastic insulating protective layer (3); using the injection molding machine to produce the cylindrical insulating protective layer (3) by injection moulding; wherein the elastic insulating protective layer (3) is transparent or translucent, and an inner diameter of the elastic insulating protective layer (3) is slightly larger than an outer diameter of the conductive layer (2); wherein the elastic insulating protective layer is coated with a lubricant disposed on an inner surface thereof; the elastic insulating protective layer (3) is sleeved on a periphery of the conductive layer to form the elastic headphone wire with high tenacity and flexibility Wherein the enameled wires comprises the same or a different color of paint disposed on surfaces thereof, so that the conductive layer is woven into plane patterns. The plane patterns can be observed through the transparent or translucent elastic insulating protective layer (3).

An elastic headphone wire comprises an elastic core wire (1), a conductive layer (2) woven on an outer surface of the elastic core wire (1), and an elastic insulting protective layer (3) sleeved on a periphery of the conductive layer (2). Wherein the conductive layer (2) is woven into an elastic stretchable mesh tube by enameled wires with the elastic core wire (1) at the center. Wherein the elastic insulating protective layer (3) is coated with a lubricant disposed on an inner surface thereof.

Wherein the enameled wires comprises the same or a different color of paint disposed on surfaces thereof, so that the conductive layer is woven into plane patterns.

The elastic headphone wire is composed of the elastic core wire (1), the conductive layer (2), and the elastic insulating protective layer (3), so the elastic headphone wire has excellent flexibility and longer extension length, extends the service life, and broaden the use way of the headphone wire.

The lubricant coated on the inner surface of the elastic insulating protective layer (3) can avoid wear and tear between the elastic insulating protective layer (3) and the conductive layer (2) when the elastic headphone wire is being bent or extended.

The enameled wires painted with different colors on the surface can be woven in colorful pattern.

It will be evident to those skilled in the art that the invention is not limited to the details of the foregoing illustrated embodiments and that the present invention may be embodied in other specific forms without departing from the spirit or essential attributes thereof The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A method of manufacturing elastic headphone wire, comprising steps of:

I. manufacturing an elastic core wire: using an injection molding machine to produce an elastic yarn as the elastic core wire of the elastic headphone;

II.weaving a conductive layer: weaving the conductive layer around an outer surface of the elastic core wire, wherein the conductive layer is an elastic stretchable mesh tube woven by enameled wires with the elastic core wire at the center, and the elastic stretchable mesh tube is coupled with the elastic core wire;

III. manufacturing an elastic insulating protective layer: using the injection molding machine to produce the cylindrical insulating protective layer by injection moulding;

wherein the elastic insulating protective layer is transparent or translucent, and an inner diameter of the elastic insulating protective layer is slightly larger than an outer diameter of the conductive layer, the elastic insulating protective layer being sleeved on a periphery of the conductive layer to form the elastic headphone wire;

wherein the elastic insulating protective layer is coated with a lubricant disposed on an inner surface thereof.

2. The method of manufacturing elastic headphone wire according to claim 1, wherein the enameled wires comprises the same or a different color of paint disposed on surfaces thereof, so that the conductive layer is woven into plane patterns.

3. An elastic headphone wire in accordance with the manufacturing method of claim 1, comprises an elastic core wire, a conductive layer woven on an outer surface of the elastic core wire, and an elastic insulting protective layer sleeved on a periphery of the conductive layer; wherein the elastic insulating protective layer is coated with a lubricant disposed on an inner surface thereof.

4. The elastic headphone wire according to claim 3, wherein the conductive layer is woven into an elastic stretchable mesh tube by enameled wires with the elastic core wire at the center.

5. The elastic headphone wire according to claim 3, wherein the enameled wires comprises the same or a different color of paint disposed on surfaces thereof, so that the conductive layer is woven into plane patterns.

* * * * *